US006653040B2

(12) United States Patent
Ohba et al.

(10) Patent No.: US 6,653,040 B2
(45) Date of Patent: Nov. 25, 2003

(54) ELECTROPHOTOGRAPHIC CARRIER, DEVELOPER USING THE SAME, AND DEVELOPING METHOD

(75) Inventors: Katsunori Ohba, Oyama (JP); Toshiro Kogawara, Iwatsuki (JP); Takeshi Isonaka, Ageo (JP); Shinji Amaya, Saitama (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 09/981,786

(22) Filed: Oct. 19, 2001

(65) Prior Publication Data

US 2002/0081514 A1 Jun. 27, 2002

(30) Foreign Application Priority Data

Oct. 27, 2000 (JP) ..... P2000-328679

(51) Int. Cl.[7] ..... G03G 9/113

(52) U.S. Cl. ..... 430/111.32; 430/111.4; 430/111.35; 430/97; 430/120

(58) Field of Search ..... 430/111.33, 111.32, 430/111.31, 111.35, 109.4, 111.4, 97, 120

(56) References Cited

U.S. PATENT DOCUMENTS

| | | | | |
|---|---|---|---|---|
| 5,496,673 A | | 3/1996 | Saitoh et al. | 430/106.6 |
| 5,672,455 A | | 9/1997 | Yanagida et al. | 430/108 |
| 6,071,663 A | * | 6/2000 | Matsuda et al. | 430/111.35 |
| 6,124,068 A | * | 9/2000 | Kobayashi et al. | 430/111.35 |
| 6,136,489 A | | 10/2000 | Takehara | 430/108 |
| 6,316,156 B1 | * | 11/2001 | Takiguchi et al. | 430/111.33 |
| 2002/0006570 A1 | * | 1/2002 | Kayamoto et al. | 430/111.35 |
| 2002/0015905 A1 | * | 2/2002 | Isonaka et al. | 430/111.35 |

FOREIGN PATENT DOCUMENTS

| | | |
|---|---|---|
| EP | 0424136 A2 | 4/1991 |
| EP | 0974873 A2 | 1/2000 |
| JP | 6-11898 | 1/1994 |
| JP | 9-106108 | 4/1997 |

OTHER PUBLICATIONS

European Search Report dated Mar. 21, 2002.

* cited by examiner

*Primary Examiner*—Christopher Rodee
(74) *Attorney, Agent, or Firm*—Armstrong, Westerman & Hattori, LLP

(57) ABSTRACT

The present invention provides a carrier for electrophotography, which is capable of charging the toner in the developer very rapidly to a target electrostatic charge and at the same time, is capable of maintaining the target electrostatic charge during printing, so that the chemical fogging related to the slow charging rate can be eliminated and the image density related to the maintenance of the electrostatic charge can be preserved during printing. The charging rate and the charge maintenance of the electrophotographic carrier can be preserved if the carrier composed of magnetic core particles and the resin coat satisfies the following equation (B)>[(−19.4)×(A)+31], wherein (A) represents a carbon content (weight %) of the carrier and (B) represents a ratio of the square root of the number of emitted photoelectrons ($(CPS)^{1/2}$) and the photon energy (eV).

8 Claims, 3 Drawing Sheets

ELECTROPHOTOGRAPHIC CARRIER, DEVELOPER USING THE SAME, AND DEVELOPING METHOD

BACKGROUND OF THE INVENTION

1. Field of the Invention

The present invention relates to magnetic carriers used for charging toners contained in a two component-type electrophotographic developer comprising the carrier and the toner, the electrophotographic developers containing the same carrier, and to a developing method.

2. Description of the Related Art

One of the important properties required for a magnetic carrier used as one component of an electrophotographic developer is a quick charging property of a toner, which is another component of the electrographic developer. The magnetic carrier is required to charge the toner rapidly. In other words, the carrier is required to have a high charge build-up rate. If a portion of the toner supplied into the developing machine while printing does not charge rapidly, this portion of the toner will have too low an electrostatic charge for developing the image, and the toner may be scattered on printed sheets including on the background portion. As a result, the insufficiently charged toner will contaminate the prints, causing a phenomenon called "photographic foggingging" or "chemical foggingging". In order to eliminate the insufficient charging and the photographic foggingging, various countermeasures have been proposed conventionally. In particular, extensive studies have been carried out in order to obtain superior magnetic core materials in terms of properties of materials, particle size, the surface coating, and further research was carried out to find suitable resin materials and the effects of heat treatments on the properties of the resin coated carriers. In order to reduce the photographic fogging, several measures were conventionally proposed such as improving the charging property of the carrier for the toner and improving the electric resistance of the developer composed of the carrier and the toner.

Examples of conventionally proposed techniques follow. Japanese Patent Application, First Publication No. Sho 47-17435 proposes to employ a fluororesin. Japanese Patent Application, First Publication No. Sho 60-19156 discloses that coating of a silane-coupling agent makes it possible to improve image density to a satisfactory level and to decrease the photographic fogging of images. Japanese Patent Application, First Publication No. Sho 61-20464 proposes to incorporate a conductive material in a silicone resin.

Japanese Patent Application, First Publication No. Sho 64-91144 discloses that a preferable image quality having no photographic fogging, no uneven density, and no blurring can be obtained by application of a mechanochemical treatment to silicone resin coated carrier particles, wherein the mechanochemical treatment is carried out by stirring the coated carrier particles mechanically until the carrier particles can charge the toner approximately 1.2 to 2.5 times. Japanese Examined Patent Application, Second Publication No. Hei 6-73030 discloses that carrier particles coated with a coating layer formed by a fluororesin, in which fluororesin particles are dispersed, shows a high image quality having no photographic fogging and a high stability over time in maintaining the charge. Japanese Patent Application, First Publication No. Hei 11-125934 discloses that a sufficient amount of charge can be obtained for the toner from the beginning of the printing by applying an impact force on the carrier particles coated with a silicone resin so as to accumulate a 1.5 times larger amount of electrostatic charge in the developer, which results in obtaining a high quality image having no photographic fogging over a long term.

However, photographic fogging is a complicated phenomenon and a complete solution to this problem is not yet obtained. The carrier is required to have characteristics such that the carrier not only charges the toner quickly to a predetermined level, but also the predetermined level of electrostatic charge must be maintained constant while printing. This is because the image density must be maintained constant while printing. A technique compatible with the quick charging and the long-term charge maintenance property is still a problem to be solved, because the quick charging is related to preventing the photographic fogging and the long-term charge maintenance property is related to the time-dependent reliability of the image density.

Recently, the charging or electrification mechanism between the carrier and the toner has been extensively studied. It is assumed that one possible mechanism is that the toner is charged as a result of an electron exchange process between the toner and the carrier due to the difference of surface energy levels of the toner and the carrier when the carrier is in contact with the toner. The surface energy level is related to a property which is called a work function. In general, when two substances having different work functions are in contact, the substance having a lower work function has a tendency to donate electrons (i.e., is likely to be positively electrified).

Various methods are proposed for measuring the work function of a substance, and, in general, the work function is obtained by measuring photoelectrons emitted from an object when light beams of various wavelengths are irradiated onto the object. Since the photoelectrons will not be emitted if the irradiated light does not exceed a certain energy level, an observation of the relationship between the light wavelength (photon energy) and the photoelectron emission makes it possible to obtain the minimum energy at which the photoelectron emission starts. Not only light beams but also X-rays or electron beams may be employed as the radiation, and the measurement is performed in a vacuum chamber in order to carry out an accurate observation of photoelectron emission.

Recently, however, a low energy electron counting apparatus has been developed which carries out the measurement of the work function by irradiation of ultraviolet light on an object in air. The above-described apparatus is becoming widely used in the fields of developers including toners and carriers for measuring their work functions. Japanese Patent Application, First Publication No.9-10610 defines the relationship between work functions of the toner and the carrier. Japanese Patent (Granted) Publication No. 2954786 discloses that a toner having superior color reproducibility can be obtained by identifying the differences of work functions of three primary color toners.

However, merely the work function is not sufficient for clarifying the electrostatic charging behaviors of the carrier and the toner, although the work function is one of the measures with respect to the charging performance. In the conventional carriers and toners developed employing the work function as a measure of electrification behaviors, a superior carrier is not yet available, which has performances of both quick charging and the charge maintenance properties, both of which are respectively required for eliminating the photographic fogging of an image and for maintaining the image density.

SUMMARY OF THE INVENTION

An object of the present invention is to provide a method of developing electrostatic images by using a carrier for electrophotography, which is compatible not only for the quickly charging the toner but also for maintaining the necessary charge during printing.

The first aspect of the present invention provides an electrophotographic carrier by coating magnetic particles with a resin, wherein the carrier satisfies the following equation $(B)>(-19.4)\times(A)+31$, wherein, (A) represents the carbon content in weight percent, and (B) represents the ratio of a square root ($(CPS)^{1/2}$) of a number of emitted photoelectrons (CPS) to a excitation energy (eV).

The second aspect of the present invention is related to an electrophotographic developer, provided with a toner comprising at least a colorant and a binder resin and the above-described carrier.

The third aspect of the present invention provide a method for developing electrostatic images using the above described developer for the electrophotography.

According to the present invention, the use of the electrophotographic carrier that satisfies the above-described equation makes it possible to improve the charge build-up of the toner and to reduce the time until the toner is charged to a necessary amount of electrostatic charge. As a result, the chemical fogging can be eliminated and the image density can be maintained constant.

The inventors of the present invention prepared a number of binary developers composed of various carriers and toners and the charging and printing behaviors of toners were evaluated in order to examine the correlations between (A) corresponding to the carbon content (weight %) of the carrier, and (B) which is a ratio of the square root of the number of emitted photoelectrons ($(CPS)^{1/2}$) and a excitation energy (eV). In test production of carriers, the type and the amount of resin for coating the core particles of the carrier were changed, and the shearing force applied to the carrier during production and the method of surface coating were changed. The relationship between (A) and (B) are shown in FIG. 3, by plotting (A) on the horizontal axis for (A) and plotting (B) on the vertical axis. The carriers which exhibit superior charging and printing behaviors are marked by ○, carriers which exhibit relatively good charging and printing behaviors are marked by ¤, and carriers showing inferior charging and printing behaviors are marked by ×. The inventors of the present invention discovered the fact that, as shown in FIG. 3, the carriers which have a superior charging and printing behavior have the value of (B) above the line expressed by $(B)=[(-19.4)\times(A)+31]$, that is, the value of (B) which is greater than the value obtaining by calculating the formula $[(-19.4)\times(A)+31]$.

The value of (A) is a carbon content of the carrier obtained by calculating from the amount of carbon dioxide and carbon monoxide generated by firing the carrier in oxygen flow.

Specifically, (A) is a value obtained by dividing the total carbon content obtained by measurement of amounts of carbon dioxide and carbon monoxide generated at the time of combustion of the resin coated carrier by the total weight of the carrier before combustion. Accordingly, the value (A) of the present invention means the carbon content (weight %) of the resin coated carrier.

The carbon content is obtained by the following conditions.

Sample weight: 0.5 g
Combustion temperature: 1250° C.
Measuring time: 30 seconds
Measuring temperature: 25° C.
Measuring humidity: 60%

The value (B) is obtained by the following conditions.

Test apparatus: AC-1 (Riken Keiki Co.)
Quantity of light: 500 nW
Anode voltage: 3300 to 3450 V
Distance between an object and a detector: 1 mm
Measuring range: 6.0 to 3.8 eV
Measuring time: 10 seconds /1 point
Measuring temperature: 25° C.
Measuring humudity: 60%

Furthermore, explanations are provided below about the low energy electron spectroscopic apparatus and the value (B) obtained by the measuring values of the above apparatus. The low energy electron spectroscopic apparatus AC-1 produced by Riken Keiki Co. was used to measure the value (B) employed in the present invention. FIG. 1 shows a schematic constitution of AC-1. A 500 nW light source was used as the light source for the ultraviolet light. The light beam emitted from the light source is separated into optional beams having a wavelength in a range of 200 to 360 nm and the separated lights are used for irradiation of the sample surface. The light beams having a wavelength in a range of 200 to 360 nm have a light energy ranging from 6.0 to 3.4 eV. In the present invention, the monochromatic beam having an energy range from 6.0 to 3.8 eV is used as the light beam for irradiation in the present invention. When an object is swept by the monochromatic light beams in sequence from the lower energy beam to the higher energy beam, the detector starts detecting a photoelectron emission due to the photoelectric effect. The energy of the light beam at which the photoelectron emission starts is the value called a photoelectric work function (work function). Electrons emitted from the sample ionize oxygen molecules in air and the ionized oxygen molecules are transferred to the low energy electronic counter (detector), where the ionized oxygen molecules emit electrons, and the number of emitted electrons are counted. As a result, a linear relationship is obtained between the square root ($(CPS)^{1/2}$) of the number of emitted electrons and the excitation energy (eV). The slope B in FIG. 2 is the value (B) of the present invention. That is, the slope B $[(CPS)^{1/2}/eV]$ is a ratio of the square root of the number of emitted electrons $(CPS)^{1/2}$ and the excitation energy (eV) and this slope B corresponds to the value (B) in the equation of the present invention.

Note that the number of emitted electrons is measured in CPS (Counts Per Second), which is the number of photoelectrons emitted from the sample surface per second. The excitation energy (eV) is the energy which is received by the sample.

DETAILED DESCRIPTION OF THE INVENTION

Figure 1:
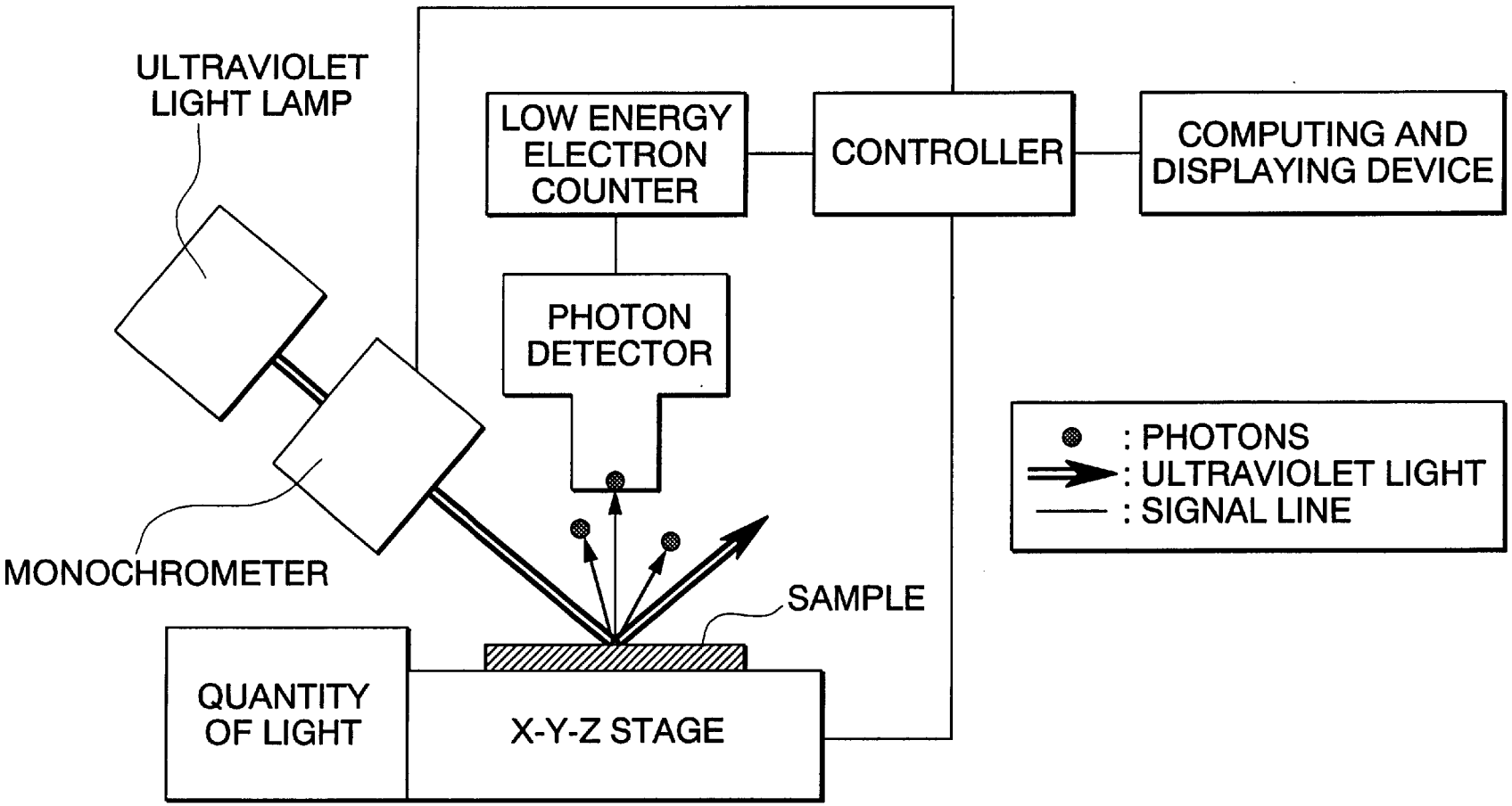
FIG. 1 is a schematic diagram showing the structure of the low energy electron spectroscopy apparatus.
Figure 2:
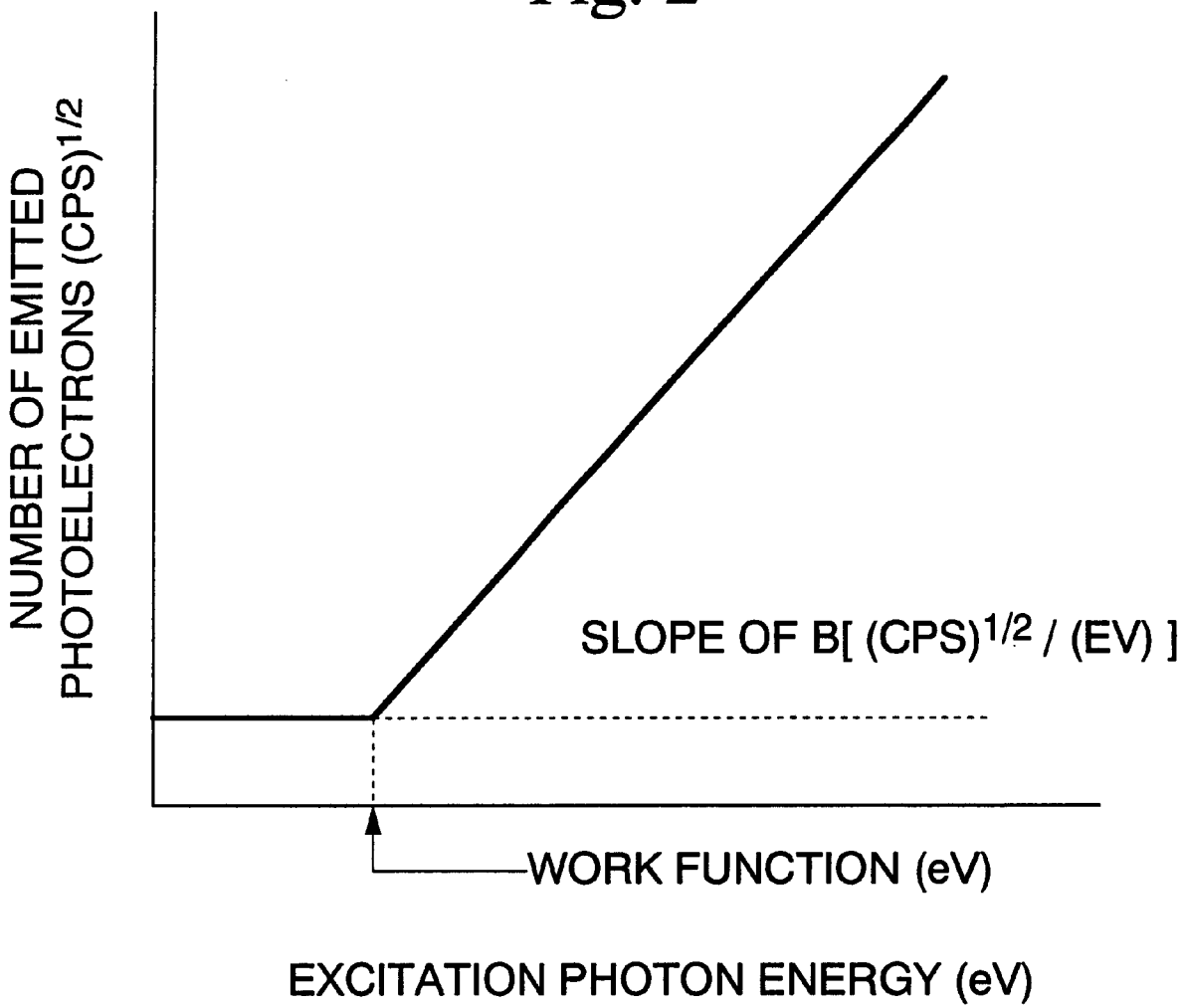
FIG. 2 is a diagram showing the relationship between the square root of the emitted number of photoelectron ($(CPS)^{1/2}$) and excitation energy (eV) and the slope B ($(CPS)^{1/2}/(eV)$).
Figure 3:
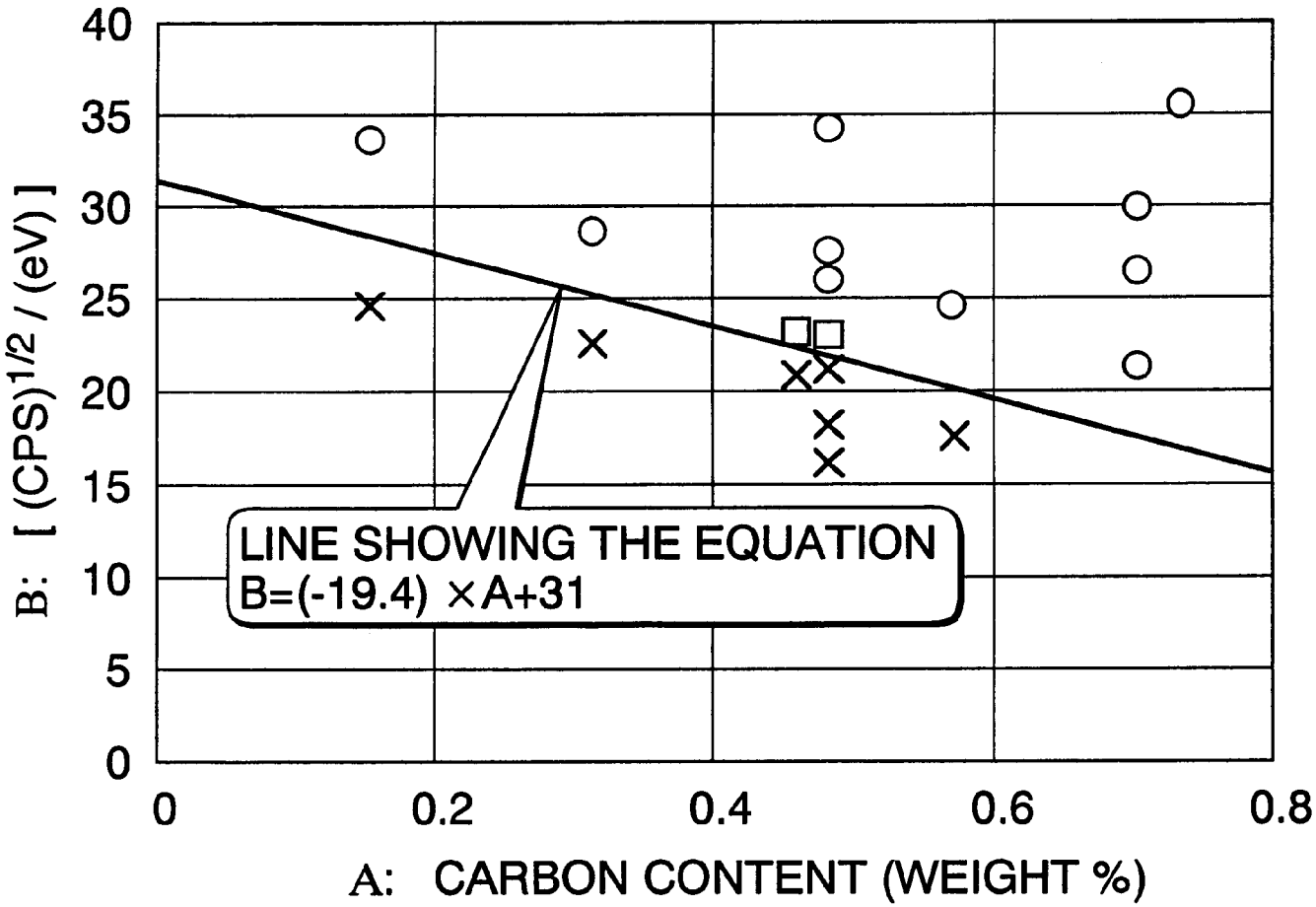
FIG. 3 is a diagram showing the relative relationship between the factor A, which is the weight percent of carbon contained in the carrier and the slope B, which is a ratio between the root square of the emitted number of photoelectron ($(CPS)^{1/2}$) and excitation energy (eV).

The carrier used for electrophotography employed in the present invention is a carrier formed by coating magnetic particles with a resin. Examples of the magnetic particles as the core material of the carrier particles include powders of iron oxide, magnetite, and ferrite. Ferrite is preferable as the carrier powder, and the ferrite powder containing manganese is more preferable because its properties, such as the charging property and the electrical resistance, are preferably balanced.

Core particles in any shape such as a scale-shape or an egg-shape can be used from the points of view of balancing properties such as flowability, electrical resistance, and electrification. Above all, spherical particles are most preferable for the core material of the carrier because of its high flowability. The core particles having an average particle size ranging from 1 to 500 $\mu$m can be employed. However, it is preferable to employ core particles having average particle diameters from 30 to 110 $\mu$m.

Examples of resins used for coating the core particles include polyethylene, polypropylene, polystyrene, polyacrylonitrile, polyvinylacetate, polyvinyl alcohol, polyvinylbutyral, polyvinylchloride, polyvinylcarbazol, polyvinyletherpolyvinylketone, a vinlychloride/vinylacetate copolymer, a styrene/acryl copolymer, straight silicone resin and its derivatives constituted by an organosiloxane bond, fluororesin, (meth)acrylate, polyester, polyurethane, polycarbonate, phenol resins, amino resins, melamine resins, benzoquanamine, urea resins, amide resins, epoxy resins, acrylpolyol resins.

In the above-described examples, silicone resins, fluororesins, and (meth)acrylate resins are preferable because they can provide coated particles having a stable charging property and a high coat strength. As described above, a preferable carrier is obtained by using ferrite as a core material and by coating the core particles with more than one type of resin selected from the group containing a silicone resin, fluororesin, and a (meth)acrylate resin. In these resins, the silicone resin is particularly preferable because toner is difficult to adhere on the surface of the carrier particles. In addition, it is also possible to carry out a crosslinking reaction of the coated resin after coating for adjusting the strength of the coated resin and the amount of charge. If necessary, it is possible to coat the carrier particles by a resin homogeneously to a uniform thickness or to coat to form dots so as to expose a part of the core surface.

In the coating resin, a conductivity regulator (such as carbon black), a quaternary ammonium salt, and a catalyst may be incorporated. Examples of the conductivity regulators include carbon blacks such as acetylene black, channel black, furnace black, and Ketchen black; metal carbide such as SiC and TiC; metal nitride such as BN, NbN, and TiN; metal boride such as MoB, CrB, and $TiB_2$; metal oxide such as ZnO, $TiO_2$, and $SnO_2$; and fine metal powders such as Al and Ni. The average particle sizes represented as the number average diameter of these conductivity regulators preferably lies within a ranges of 0.01 to 5 $\mu$m, and more preferably within a range of 0.05 to 3 $\mu$m. This average particle size can be measured under a transmission electron microscope. Above all, the most preferable conductivity regulator is carbon black.

A method of forming the resin coated carrier will be described below.

(1) A method of forming coated carrier particles by coating a resin on the core carrier particles.

Although any method can be used to coat the resin film on the surface of core particles, examples of coating methods include a dipping method to coat the core particles by dipping into a resin solution, a spray method by spraying the resin solution on the surface of the core particles, a floating bed method by coating while the core particles are floated by floating air, and a kneader coater method by mixing the core particles with the resin solution and removing a solvent thereafter. Although the solvents to be used for the resin solution are not limited, examples of the solvents include toluene, xylene, acetone, methylethylketone, tetrahydrofuran, and dioxane. A problem arises in this case in that the core particles will be adhered to each other by the coated resin layer.

(2) In the case that a thermal crosslinking type resin (for example, a silicone resin) is used, a thermal treatment is conducted after coating at a temperature in a range of 150 to 300° C. This thermal treatment thereby enhances crosslinking of the coated resin but still a problem remains in that the carrier particles adhere to each other.

(3) The coated carrier particles, which are adhered to each other, are loosened and separated.

As described above, the coated core particles are produced by the above methods. However, the core particles (magnetic material) after coating are liable to aggregate. In order to loosen the aggregated particles, the following loosening treatments are adopted. A representative loosening process is conducted as follows. The aggregated carrier particles are put into a sealing container, if necessary, together with hard beads such as zirconia beads and they are mixed and stirred. Stirring is industrially conducted using mixers such as Henschel-type mixer, Nautor-type mixer, and W-cone type blender for loosing the aggregate by applying a shearing force and a carrier particles having a predetermined particle size distribution are obtained.

The coated carrier particles are produced by, for example, the above-described methods. In order to satisfy the relationship between (A) and (B), it is preferable to treat the carrier particles during the resin coating process or after the resin coating process as follows.

(1) Adjustment of the shearing force applied to the aggregate during loosening of the aggregate. The shearing force applied to the aggregate can be adjusted by selecting the suitable process conditions such as time, speed, and force for the loosening process and by selecting a suitable loosening method. In general, the value of (B) increases as the shearing force increases.

(2) The value of (B) can be increased by performing a dry etching process to the carrier particles using an ion sputtering apparatus, for example, after the normal loosening process.

When the amount of coated resin is increased, the right side of the equation expressing the relationship between (A) and (B) becomes small. However, the increasing amount of resin generally decreases the value of (B), so that it is not preferable to increase the amount of coated resin beyond what is necessary. The necessary amount of the coated resin reduced as a carbon content is preferably within a range of 0.05 to 3.0%, more preferably within a range of 0.1 to 1.5%, and most preferably within a range of 0.3 to 0.9%.

The toner used in the present invention is not limited. Any resin may be used for binding the toner without any limitation if the resin can be ordinarily used for binding resin. Examples of resins for binding toners include polystyrene, styrene-(meth)acrylate ester copolymer resin, olefin resin, polyester resin, amide resin, polycarbonate resin, epoxy-type resins, and graft polymers of these resins and their mixtures.

Among these resins, in view of the charge stability, the charge maintenance stability, fixing characteristics, and color reproducibility when the resin is used for binding color toners containing organic color pigments, it is preferable to use resins including polyester resins, styrene-(metha) acrylate ester copolymer resins.

The polyester resin used as a binder resin for the toner used in the present invention is obtained, for example, by normal dehydration condensation of dicarboxylic acid and diol. Examples of dicarboxylic acid include dicarboxylic acids or their derivatives such as phthalic anhydride, terephthalic acid, isophthalic acid, orthophthalic acid, adipic acid, maleic acid, maleic anhydride, fumaric acid, itaconic acid, citraconic acid, hexahydrophthalic anhydride, cyclohexanedicarboxylic acid, succinic acid, malonic acid, glutaric acid, azelaic acid, and sebacic acid.

Examples of diols include ethylene glycol, diethylene glycol, propylene glycol, dipropylene glycol, tripropylene glycol, butanediol, pentanediol, hexanediol, bisphenol A, polyoxyethylene-(2,0)-2,2-bis(4-hydroxylphenyl)propane and its derivatives, polyoxypropylene-(2,0)-2,2-bis(4-hydroxylphenyl)propane, polyoxypropylene-(2,2)-polyoxyethylene-(2,0)-2,2 bis(4-hydroxylphenyl)propane, polyoxypropylene-(6)-2,2-bis(4-hydroxylphenyl)propane, polyoxypropylene-(2,2)-2,2-bis(4-hydroxylphenyl)propane, polyoxypropylene-(2,4)-2,2-bis(4-hydroxylphenyl)propane, and polyoxypropylene-(3,3)-2,2-bis(4-hydroxylphenyl) propane and its derivative.

Examples of diols further include diols such as polyethylene glycol, polypropylene glycol, ethylene oxide-propylene oxide block copolymer diol, ethylene oxide -tetrahydrofuran copolymer diol, and polycaprolactone diol.

Furthermore, if necessary, it is possible to use the following compounds in combination with the above compounds, which include more than trifunctional aromatic carboxylic acids and its derivatives such as trimellitic acid, trillitic anhydride, pyromellitic acid, and pyromellitic anhydride; trifuctional alcohols such as sorbitol, 1,2,3,6-hexanetetraol, 1,4-sorbitane, pentaerythritol, 1,2,4-butanetriol, 1,2,5-pentaerythritol, glycerine, 2-methylpropanetriol, 2-methyl-1,2,4-butanetriol, trimethylolethane, trimethylolpropane, 1,3,5-trimethylolbenzene; more than trifunctional polyhydric epoxy compounds such as bisphenol A-type epoxy resin, bisphenol F-type epoxy resin, ethyleneglycoldiglycyldiether, hydroquinondiglycidyldiether, N, N-diglycidylaniline, glycerinetriglycidylether, trimethylolpropanetriglycidylether, trimethylolethanetriglycidylether, pentaerythritoltetraglycidylether, cresolnovolak-type epoxyresin, phenolnovolak-type epoxyresin, polymers or copolymers of vinyl compounds having epoxy groups, epoxidated resorcinol-acetone condensation products, partially epoxidated polybutadiene, and more than one type of semi-drying or drying fatty-acid ester epoxy compounds.

The above-described polyester resins are obtained by dehydration condensation reactions or the ester exchange reactions using the above-described material components. Although the reaction time and the reaction temperature of the above reactions are not limited, it is preferable to carry out these reactions at temperatures ranging from 150 to 300° C. for 2 to 24 hours.

The above-described reactions are conducted in the presence of suitable catalysts such as zinc oxide, stannous oxide, dibutyltuin oxide, and dibutyltindiuranate.

Any type of polyester resin may be used as the binder of the toner if the resins have suitable glass transition temperature and suitable viscosity characteristics when melted. From the point of view of the fixing property, a characteristic temperature of the polyester resins, at which the viscosity reaches $1\times10^5$ poise, is preferably equal to or higher than 95° C., and more preferably, the characteristic temperatures range from 95 to 170° C., and most preferably, the characteristic temperatures range from 95 to 160° C.

On the other hand, the glass transition temperature (Tg) of the polyester resins is preferably equal to or higher than 40° C. The acid value of the polyester resins is preferably lower than 30. If the acid value is too high, a necessary amount of charge may not be obtained, since the resin will prevent the electrification of the toner.

Examples of styrene monomers used for resins obtained by copolymerization of styrene-(meth)acrylateester include styrene, α-methylstyrene,vinyltoluene, p-sulfonstyrene, dimethylaminomethylstyrene.

Examples of (meth)acrylate ester monomers include alkyl-(meth)acrylates such as methyl (meth)acrylate, ethyl (meth)acrylate, n-propyl (meth)acrylate, isopropyl (meth) acrylate, n-butyl (meth)acrylate, isobutyl (meth)acrylate, tertiary-butyl(meth)acrylate, octyl(meth)acrylate, 2-ethylhexyl(meth)acrylate, lauryl (meth)acrylate, and stearyl (meth)acrylate; alicyclic (meth)acrylates such as cyclohexyl (meth)acrylate; aromatic (meth)acrylates such as benzyl (meth)acrylate; hydroxyl group containing (meth) acrylates such as hydroxyethyl (meth)acrylate; phosphate group containing (meth)acrylates such as (meth) acryloxyethylphospahte; halogen atom containing (meth) acrylates such as 2-chloroethyl (meth)acrylate, 2-hydroxy-3-chloropropyl (meth)acrylate, and 2, 3-dibromopropyl (meth)acrylate; epoxy-group containing (meth)acrylates such as glycidyl (meth)acrylate; ether-group containing (meth)acrylates such as 2-methoxyethyl (meth)acrylate and 2-ethoxyethyl(meth)acrylate; basic nitrogen atom or amide-group containing (meth)acrylates such as dimethylaminoethyl (meth)acrylate and diethylaminoethyl (meth)acrylate.

In addition, if necessary, it is possible to use copolymerizable unsaturated compounds in combinations with these compounds shown above in the copolymerization reactions of styrene-(meth)acrylate ester. Examples of copolymerzable unsaturated compounds include carboxyl-group containing vinyl monomers such as (meth)acrylate, itaconic acid, crotonic acid, maleic acid, and fumaric acid; sulfoggingroup containing vinyl monomer such as sulfoethylacrylamide; nitryl-group containing vinyl monomer such as (meth)acrylonitryl; ketone-group containing vinyl monomers such as vinylmethylketone and vinylisopropenylketone; basic nitrogen atom or amide-group containing vinyl monomers such as N-vinylimidazol, 1-vinylpyrrol, 2-vinylquinoline, 4-vinylpyridine, N-vinyl-2-pyrrolidone, and N-vinylpiperidone.

Furthermore, a crosslinking agent may be used in the copolymerization reaction within a range of 0.1 to 2 weight %. Examples of crosslinking agents include divinylbenzene, divinylnaphthalene, divinylether, ethyleneglycol di(meth) acrylate, diethyleneglycol di(meth)acrylate, triethyleneglycol di(meth)acrylate, polyethyleneglycol di(meth)acrylate, 1,3-butyleneglycol di(meth)acrylate, 1,6-hexaneglycol di(meth)acrylate, neopentylglycol di(meth)acrylate, propyleneglycol di(meth)acrylate, dipropyleneglycol di(meth) acrylate, polypropyleneglycol di(meth)acrylate, trimethylolpropane tri(meth)acrylate, tetramethylolmethane tetra (metha)acrylate.

In contrast, styrene-(meth)acrylate resins obtained by copolymerization of the above-described carboxyl-group containing vinyl monomers may be further crosslinked by use of halides, hydroxides, oxides, carboxylic acids, alkoxylates, and chelates of metal salts containing Al, Ba, Ca, Cd, Co, Cr, Cu, Fe, Hg, Mg, Mn, Ni, Pb, Sn, Sr, and Zn, etc. The crosslinking reaction can be conducted in the presence of solvents by heating and stirring.

Copolymerization of styrene-(meth)acrylate ester may be implemented by use of various polymerization methods such as solution polymerization, dispersion polymerization, and block polymerization in the presence of a polymerization catalyst.

Examples of the polymerization catalysts include 2,2'-azobis (2,4-dimethylvaleronitril), 2,2'-azobisisobutylonitril, 1,1'-azobis(cyclohexane-1-barbonitril), benzoylperoxide, dibutylperoxide, and butylperoxidebenzoate. The amount of the catalyst used in the polymerization reaction is preferably in a range of 0.1 to 10 weight % of the vinyl monomer.

The above-described styrene-(meth)acrylate ester copolymers my be used for the two-component development toner, if the copolymers have an appropriate glass transition temperature and an appropriate characteristic temperature obtained from the melt-viscosity characteristics. The characteristic temperature, at which the viscosity of the melt reaches $1\times10^5$ poise, is preferably higher than 95° C., is more preferably in a range of 95 to 170° C. from the point of view of fixing property at lower temperatures, and is most preferable when the characteristic temperature is in a range of 95 to 160° C.

The glass transition temperature (Tg) of the above-described styrene-(meth)acrylate copolymers is preferably equal to or more than 40° C., and a more preferable range is 45 to 85° C.

In addition, the acid value of the copolymer is preferably below 30, and more preferably below 15. If the acid value is too high, the amount of charge of the toner is reduced because such copolymers degrade the charging property of the toner.

The toner used for preparing the developer in combination with the electrophotographic carrier of the present invention is not limited to any one of negatively charged or positively charged toners. The positively charged toner containing the polyester resin is preferably used in combination with the styrene-acrylate type toner, since the toner using the styrene-acrylate type polymer has problems because the toner is hard to charge positively and the positive charge is not stably maintained during printing.

When a low melting polyester resin having a linear chain structure is used in combination with the high melting polyester resin having a branched or crosslinked structure, a preferable toner is obtained which exhibit prominent low temperature fixing properties and excellent offset-preventing properties. The branched and crosslinked polyester resin is produced by use of polyhydric alcohol containing more than three hydroxide groups.

Various colorants such as carbon black, various organic pigments, inorganic pigments, dye may be used for the toner of the present invention without any limitation. Examples of colorants follow.

The following known colorants are used in the toner. Examples of black colorants include carbon blacks such as furnace black, channel black, acetylene black, thermal black, lamp black, and Ketchen black, which are named by production methods. Examples of blue colorants include C. I. Pigment Blue 15-3 in a phthalocyanine system and C. I. Pigment Blue 60 in an indanthrone-system; red colorants include C. I. Pigment Red 122 in a quinacridone-system, C. I. Pigment Red 48:1 C. I. Pigment Red 43:3, and C. I. Pigment Red 57:1 in an azo-system; yellow colorants include C. I. Pigment Yellow 12, C. I. Pigment Yellow 13, C. I. Pigment Yellow 14, C. I. Pigment Yellow 17, C. I. Pigment Yellow 97, and C. I. Pigment Yellow 155, in the azo system, C. I. Pigment Yellow 110 in an isoindolinone system, C. I. Pigment Yellow 151, C. I. Pigment Yellow 154, C. I. Pigment Yellow 180, and C. I. Pigment Yellow 185 in a benzimidazolon system. It is preferable to incorporate the colorant within a range of 1 to 20 weight parts. These colorants may be used in combination of two or more.

Although the ratio of the resin and colorant is not limited, the preferable ratio of the colorant to the resin is within a range of 1 to 30 weight parts, and more preferably within a range of 1 to 10 weight parts.

When color toners are produced by use of these colorants, it is preferable to use polyester resin from the point of view of superior coloring and transparency in printing. Polyester resin is suitable for the color toner resin because of its superior toughness to be able to tolerate the stress during printing and its low melting point.

Although the toner of the present invention is not limited to a positively charged toner or a negative charged toner, various charge control agents may be used depending on need. Examples of positive charge control agents include triphenylmethane-system dyes, nigrosine-system dyes, quaternary ammonium salt compounds, or resins containing an amino group, and a particularly preferable agent is a combination of a nigrosine-system dye and a quaternary ammonium salt. Preferable examples of the quaternary ammonium salt compounds include Bontron P-151 (a trade name of a product of Orient Chemical Co.), TP-302, TP-415, and TP-610 (trade names of products of Hodogaya Kagaku Co.).

When a combination of a nigrosine -system dye and a quaternary ammonium salt compound is used, a preferable ratio of both compounds is in a range of 1/9 to 9/1, and more preferable ratio ranges from 2/8 to 8/2. Although the nigrosine-system dyes have a high charging capability, homogeneous and stable electrification is often not obtained, so that the use of a single nigrosine-system dye often causes photographic fogging and the resultant printed image insufficiently sharp. In contrast, although the quaternary ammonium salt compounds exhibits homogeneous and stable charging, the capability for positive charging is low, so that it is desirable to use the quaternary ammonium salt compounds in combination with the nigrosine-system dye for obtaining a sharp printed images without fogging during continuous printing. When the content of the nigrosine-system dye is lower than 10%, the toner will not be sufficiently charged and the transfer efficiency of the toner to the paper is degraded. As a result, the image quality of prints, especially background portions of the prints are degraded and the image resolution is also degraded. The scattering of the toner increases as a result of low electrification of the toner. When the content of the nigrosine-system dye is higher than 90%, the toner will be excessively charged so that this toner produces low density and low quality images containing dense fogging.

The proper electrification is not obtained if both compounds are not mixed in a proper ratio, and the toner having improper electrification will produces prints with low quality and low resolution having dense fogging. An optimum amount of electrification will be obtained by properly adjusting the ratio of both compounds, and a toner can be provided which is capable of developing highly dense, high quality and clearly outlined prints having no scattered toner.

Any negative charge control agent may be used without limitation if the agent can impart a negative charge to the toner. Preferable examples of the negative charge control agents include azo-system complex (salts), salicylate-system metal complex (salts), benzylic acid metal complex (salts), tetraphenyl complex (salts), calixarene-type phenol-system condensation products, cyclic polysaccharides, and resin-base charge control agents.

Examples of the azo-system complex salts include "BONTRON S-34" and "BONTRON S-44" (above are trade names of products by Orient Chemicals Co.)

Examples of the salicylate-system metal complex salts include "BONTRON E-81 ", "BONTRON E-84", and "BONTRON E-88" (the above are trade names of products by Hodogaya Kagaku Co.). Examples of benzylic acid metal complex salts include "LR-147" and "LR-297" (the above are tradenames of products by Japan Carlit Co.). An example of tetraphenyl complex salt is "COPY CHARGE NX" (tradename of a product of Clariant Co.). Exmples of the carixarene type compounds include "BONTRON E-89" and "BONTRON F-21" (the above are trade names of products by Orient Chemical Co.). An example of the cyclic polysaccharides includes "COPY CHARGE NCA" (the above is a tradename of a product by Clariant Co.).

Example of the resin-base charge control agents include "FCA-1001-NS (a tradename of a product of Fujikura Kasei Co.) and "COPY LEVEL NCS" (a tradename of a product by Clariant Co.).

The toner suitable for using the electrophotographic carrier of the present invention is a positively charging toner, which uses polyester resin as a binder resin. In addition, the toner is preferably containing a positive charge control agent.

The content of the charge control agent is preferably in a range of 0.3 to 10 weight parts per 100 eight parts of binder resin, and more preferably in a range of 1 to 5 weight parts.

When this toner is fixed using a heat roll fixing method, various waxes are incorporated in the toner, if necessary, for releasing the toner from the heat roll as an auxiliary agent in order to prevent problems caused by adhesion of the toner (offset). Examples of waxes include natural waxes such as montanic acid ester wax; and polyolefin-type waxes such as high pressure process polyethylene and polypropylene.

Among various waxes, it is particularly preferable in the present invention to employ carnauba wax, montanic ester wax, rice wax and/or coccid wax, since these waxes exhibit prominent dispersibility particularly in polyester resin and improve fixing and offset-preventing performances.

It is preferable to use non free fatty acid carnauba wax after removing free fatty acid by refining. The non free fatty acid carnabau wax preferably has an acid value of less than 8, and more preferably, less than 5. The non free fatty acid carnabau wax can be crystallized into finer crystals and has an improved dispersibility in polyester resin. The montanic ester wax is obtained by refining a mineral, and the refining process makes this wax to be crystallized into finer crystals and the dispersibility in polyester resin is improved, similarly to the case of the above carnauba wax. The acid value of the montanic ester wax is preferably less than 30.

In addition, the rice wax is obtained by refining a rice bran wax and its acid value is preferably less than 13. The coccid wax is obtained by collecting wax-like component secreted by larvae of the scale insect after dissolving it in hot water, separating the upper layer, and solidifying. The coccid wax obtained by the above refining process is a white solid, which has a very sharp meting point, and is suitable for use in the toner of the present invention. The acid value of this coccid wax is preferably less than 10, more preferably less than 5.

The above-described wax may be used alone or in combination. A preferable fixing property and a offset-preventing property are obtained by incorporating the wax in a range of 0.3 to 15 weight parts of binder resin, preferably in a range of 1 to 5 weight parts. If the content is lower than 0.3 weight parts, the offset-preventing property is degraded, and if the content is higher than 15 weight parts, the fluidity of the toner is degraded such that a part of the toner adheres on the carrier surface and a part of the carrier surface is immobilized, which deteriorates the charging property of the toner by carrier particles.

In addition to the above-described natural waxes, synthetic ester waxes may be preferably used. Examples of the synthetic ester waxes include tetrabehenic acid esters of pentaerythritol. Note that it is possible to jointly use other synthetic waxes such as polypropylene wax and polyethylene wax.

The toner used in the present invention may be produced by employing generally known manufacturing methods, and not by any particular manufacturing process. A typical manufacturing method for obtaining the toner includes mixing the resin and the colorant, melting and kneading the mixture above the meting point (softening point), cooling and pulverizing, and sieving.

More practically, the mixture composed of the essential components of the resin and the colorant are mixed by a kneading machines such as a two-roll kneder, a three-roll kneader, a press kneader, and a two-axial extruder. The mixing is performed for dispersing the colorant homogeneously in the resin medium. Although kneading conditions are not particularly limited if the above objective is attained, the kneading time ranges from 30 seconds to 2 hours at a normal kneading temperature of 80 to 180° C. In order to disperse the colorant in the resin, the colorant may be mixed with the resin medium as a pretreated powder by a flashing treatment or as a master batch which is prepared by melt kneading a batch containing a high concentration of the colorant.

After the kneading operation, the kneaded product is pulverized by, for example, a jet mill and sieved by, for example, a blower classifier.

Although there is no particular limitation, the average particle size of the toner matrix is normally adjusted in a range of 5 to 15 $\mu$m.

Additives are then externally added to the toner matrix and mixed with the toner matrix by use of, for example, a Henschel-type mixer.

The additives are used for improving the quality of the toner surface, aiming to improve the fluidity of the toner or to improve the electrification property. Examples of these additives include inorganic fine powers such as silicon dioxide, titanium oxide, and alumina, these powders after surface treatment to be, for example, hydrophobic, and resin powders.

As examples of silicon oxide include hydrophobic silica powder which is obtained by surface treatment of the silica powder with a polyorganosilixane or silane coupling agents. Examples of such surface treated silica powers are commercially available.

| | |
|---|---|
| AEROSIL | R972, R974, R202, R805, R812, RX200, RY200, R809, RX50, RA200HS, RA200H (Nihon Aerosil Co.) |
| WACKER | HDK H2000, H2050EP, HDK H3050Ep, HVK2150 (Wacker Cheminals, East Asia |
| Nipsil | SS-10, SS-15, SS-20, SS-50, SS-6-, SS-100, SS-50B, SS-50F, SS-10F, SS-40, SS-70, 70, SS-72F (Nippon Silica Kogyo Co.) |

-continued

| | |
|---|---|
| CABOSIL | TG820F (Cabot Speciality Chemicals Co.) |

The content of the additive in the toner matrix is normally 0.05 to 5 weight %, and preferably 0.1 to 3 weight %.

It is possible to combine two types of silica powders, whose average particle sizes differ from each other. The content of silica powder relative to the toner matrix is normally 0.05 to 5 weight %, and preferably 0.1 to 3 weight %.

The toner produced as described above is used as a developer for the electrophotography after being mixed with the carrier of the present invention. Although there is no particular limitation to the mixing ratio, 0.5 to 15 weight parts of toner is mixed with 100 weight parts of carrier.

The carriers for electrophotography of the present invention and the electrostatic developing toner using the above carriers can be used as the electrostatic developing agent in the two-component developing machine, and this developing agent is particularly favorable for use in the high speed developing machine which has a developing belt speed of more than 20 m/min. and is further favorable for a high speed machine of more than 30 m/min. The present invention provides a developing agent or a developer, which is capable of long printing for long time at a developing speed of more than 45 m/min without causing photographic fogging or inhomogeneous image quality.

EXAMPLES

The present invention will be explained in detail referring to the Examples. Note that the present invention is not limited to these Examples. In the following Examples and in Comparative Examples, "%" represents "weight %", unless stated otherwise.

Example 1

(Preparation of Carrier)

1 part of carbon black (Ketchen Black EC, trade name of a product of Ketchen Black International Co.) and 10 parts of methyl silicone resin (SR-2140, trade name of a product of Toray Dow Silicone Co.) were dissolved in 100 parts of toluene and thus a resin coating was formed. 200 g of ferrite core powder (average particle size of 100 $\mu$m) was prepared and the above resin coating was coated on the ferrite core using a fluidized bed (spiral flow) by controlling a ratio of coating resin to the core powder at 2/10 (weight basis). After drying, the coated core powder was heat treated at 250° C. for 3 hours. 100 g of resin coated ferrite powder was mixed with 250 g of zirconia beads 2 mm in diameter and the mixture was then introduced into a resin bottle with a volume of 500 ml. The bottle was rotated on a ball-mill holder at a rotation speed of 100 rpm for 3 hours, and the carrier A was obtained.

Comparative Example 1

The coated ferrite powder was prepared similarly to Example 1 until the coated ferrite powder was treated at 250° C. for 3 hours. Then, the coated ferrite powder was stirred using zirconia beads for 15 minutes and the carrier B was obtained.

Example 2

The coated ferrite powder was prepared similarly to Example 1 except controlling the ratio of the coating resin/core powder at 5/10 in the fluidized bed coating operation. Then, the coated ferrite powder was processed similarly to the Example 1 and the carrier C was obtained.

Comparative Example 2

The coated ferrite powder was prepared by the same process as that of Example 1 until the coated ferrite powder was treated at 250° C. for 3 hours. Then, the coated ferrite powder was stirred using zirconia beads for 15 minutes and the carrier D was obtained.

Example 3

The carrier D was obtained by the same procedure with Example 1 except controlling the ratio of the coating resin/core powder at 10/10.

Comparative Example 3

The coated ferrite powder was prepared similarly to Example 1 until the coated ferrite powder was treated at 250° C. for 3 hours. Then, the coated ferrite powder was stirred using zirconia beads for 15 minutes and the carrier E was obtained.

Example 4

After preparing the carrier similarly to Comparative Example 3, a dry etched processing was carried out using an ion sputtering apparatus and the carrier G was obtained.

Resin Synthesis Example 1

The following materials and process yielded a polyester rein.

2.0 mol parts of terephthalic acid, 2.5 mol parts of isophthalic acid, 0.5 mol parts of trimellitic acid, 4.0 mol parts of polyxyethylene(2,0)-2, 2-bis(4-hydroxyphenyl)propane, and 1.2 mol parts of ethylene glycol were introduced into a four arm flask provided with a stirrer, a condenser, and a thermometer, 0.07 weight parts dibutyl tin oxide relative to all oxide components were added under a nitrogen flow, all components were reacted at 220° C. for 15 hours while removing water generated by the dehydration condensation reaction, and a resin (A) was obtained. This polyester resin (A) obtained by the above reaction showed the characteristic temperature of 155° C. at which the viscosity reaches $1\times10^5$ poise and the acid value of 10.

The characteristic temperature at which the viscosity reaches $1\times10^5$ poise was measured by use of a constant load extrusion capillary-type rheometer (Shimazu Flow Tester CFT-500C, trade name of Shimazu Seisakusho Co.). The measurement was performed under conditions such as a piston area of 1 $cm^2$, the cylinder pressure of 0.98 MPa, the die length of 1 mm, the die hole diameter of 1 mm, measurement start temperature of 50° C., the temperature programming rate of 6° C./min. and the sample weight of 1.5 g.

Resin Synthesis Example 2

A resin was synthesized by using the following materials and process.

320 weight parts of styrene, 60 weight parts of butylacrylate, 20 weight parts of methacrylic acid 4 weight parts of azobisisobutylolnitrile, and 600 weight parts of xylene were introduced into a round bottom flask, and after reacting at 80° C. for 10 hours under a nitrogen atmosphere, the polymerization was completed by increasing the temperature to 130° C. Thereafter, 2 weight parts of aluminum isopropoxide was added and after reacting for approximately one hour, the temperature was raised to 180° C. and the pressure of the flask was reduced to 0.5 mmHg for removing the solvent, and the resin A was obtained.

This resin A obtained as described above has a characteristic temperature at which the viscosity reaches $1\times10^5$ poise of 145° C., the glass transition temperature Tg of 61° C., and the acid value of 5.

Positive Charged Toner A

A toner product was obtained by the following procedure.

92 weight parts of Resin A, 5 weight parts of Morgan L carbon black (produced by Cabbot Speciality Chemicals, Inc.), 2 weight parts of refined carnauba wax No. 1 (acid value of 5, a product of CERA RICA NODA Co. Ltd.), 1.5 weight parts of charge control agent (BONTRON N-07 (Orient Chemical Co.), 1 weight part of quaternary ammonium salt TP-302 were mixed using a Henschel mixer and were kneaded using a biaxial kneader. The kneaded product was pulverized and sieved and "Toner Product A" was obtained.

100 weight parts of the above Toner Product A and 1 weight part of Silica HDK3050EP (Wacker Chemicals Co.) were mixed using a Henschel mixer and the mixture was passed through a sieve. Finally, "Toner A" was obtained.

Positive Charged Toner B 92 weight parts of Resin A obtained by Resin Synthesis Example 1.

5 weight parts of Morgan L carbon black (Cabbot Speciality Chemicals Inc.), 2 weight parts of polypropylene wax (550P, produced by Sanyo Kasei Co.)

1.5 weight parts of charge control agent (positive charge control agent) "BONTRON N07 (Orient Chemicals Co.)

were mixed using a Henschel mixer and kneaded using a biaxial kneader. The kneaded product was pulverized and sieved and "Toner product B" was obtained having an average particle size of 10.2.

"Toner B" was obtained by mixing 100 weight parts of the above "Toner Product B" with 1 weight part of Silica HDK3050EP (Wacker Chemicals Co.) and the mixture was thereafter passed through a sieve.

Evaluation 1 (Measurement of Carbon Content and Slope)

Values "A" for Examples 1, 2 and 3 and Comparative Examples 1, 2 and 3. Furthermore, using the AC-1, values B were also obtained. The results were shown in Table 1.

TABLE 1

| | | (A) (weight %) | (B) | right side of the equation |
|---|---|---|---|---|
| Example 1 | Carrier A | 0.15 | 33.4 | 28.1 |
| Comparative Example 1 | Carrier B | 0.16 | 24.7 | 27.9 |
| Example 2 | Carrier C | 0.31 | 28.2 | 25.0 |
| Comparative Example 2 | Carrier D | 0.33 | 22.4 | 24.6 |
| Example 3 | Carrier E | 0.47 | 29.3 | 21.9 |
| Comparative Example 3 | Carrier F | 0.49 | 16.2 | 21.5 |
| Example 4 | Carrier G | 0.49 | 25.3 | 21.5 |

As shown above, Examples 1, 2, 3, and 4 satisfy the equation defined by the present invention. However, Comparative Examples 1, 2, and 3 do not satisfy the equation.

Evaluation 2 (Measurement of Charge Build-Up)

(Adjustment of Developer)

"Developer (A/A)" was adjusted by mixing 6 weight parts of the above-described "Toner A" with 114 weight parts of carrier A in a cylinder-type polyethylene container having a diameter of 5 cm and a length of 6 cm.

Similarly, a series of developers shown in Table 2 were obtained.

TABLE 2

| | | |
|---|---|---|
| Developer (A/B) | 6 wt. parts of Toner A | 114 wt. parts of Carrier B |
| Developer (A/C) | 6 wt. parts of Toner A | 114 wt. parts of Carrier C |
| Developer (A/D) | 6 wt. parts of Toner A | 114 wt. parts of Carrier D |
| Developer (A/E) | 6 wt. parts of Toner A | 114 wt parts of Carrier E |
| Developer (A/F) | 6 wt. parts of Toner A | 114 wt parts of Carrier F |
| Developer (A/G) | 6 wt. parts of Toner A | 114 wt parts of Carrier G |
| Developer (B/A) | 6 wt. parts of Toner B | 114 wt parts of Carrier A |
| Developer (B/B) | 6 wt. parts of Toner B | 114 wt parts of Carrier B |
| Developer (B/C) | 6 wt. parts of Toner B | 114 wt parts of Carrier C |
| Developer (B/D) | 6 wt. parts of Toner B | 114 wt parts of Carrier D |
| Developer (B/E) | 6 wt. parts of Toner B | 114 wt parts of Carrier B |
| Developer (B/F) | 6 wt. parts of Toner B | 114 wt parts of Carrier F |
| Developer (B/G) | 6 wt. parts of Toner B | 114 wt parts of Carrier G |

The polyethylene container containing each developer was stirred for 3 minutes at a rotating speed of 115 rpm, and then the amount of electro-static charge was measured using an electrostatic charge meter (Blow-Off Electrostatic Charge Meter: Toshiba Chemicals Co.). Furthermore, stirring was performed for 7 minutes (10 minutes in total) and the amount of electrostatic charge was measured similarly. The results were shown in Table 3.

TABLE 3

| | amount of charge ($\mu$C/g) | |
|---|---|---|
| | after 3 min. | after 10 min. |
| Developer (A/A) | 7.5 | 7.9 |
| Developer (A/B) | 2.9 | 4.0 |
| Developer (A/C) | 6.7 | 7.2 |
| Developer (A/D) | 1.2 | 3.1 |
| Developer (A/E) | 5.6 | 6.0 |
| Developer (A/F) | −0.7 | 0.2 |
| Developer (A/G) | 4.7 | 5.1 |
| Developer (B/A) | 8.3 | 7.6 |
| Developer (B/B) | 5.8 | 7.5 |
| Developer (B/C) | 8.3 | 7.7 |
| Developer (B/D) | 5.3 | 7.1 |
| Developer (B/E) | 8.1 | 7.9 |
| Developer (B/F) | 4.9 | 7.0 |
| Developer (B/G) | 7.4 | 7.2 |

As seen in the above Table 3, the electrostatic charge rose rapidly in those developers containing respective carriers A, C, E, and G, and the amount of charge stored in those developers containing respective carriers A, C, E, and G were stably maintained. In contrast, the charge did not rise rapidly in developers containing respective carriers B, D, and F, and, in particular, the developer (A/F) was charged negatively.

Evaluation 3 (evaluation of print)

Test printings were conducted in a commercial printing machine (XC-810 a product of Fuji Xerox Corporation) using the developers after being stirred for 10 minutes in the previous Evaluation 2.

TABLE 4

| | Chemical fogging |
|---|---|
| Developer (A/A) | OK |
| Developer (A/B) | unsatisfactory |
| Developer (A/C) | OK |
| Developer (A/D) | unsatisfactory |
| Developer (A/E) | OK |
| Developer (A/F) | OK |
| Developer (A/G) | unsatisfactory |
| Developer (B/A) | OK |
| Developer (B/B) | unsatisfactory |
| Developer (B/C) | OK |
| Developer (B/D) | unsatisfactory |
| Developer (B/E) | OK |
| Developer (B/F) | unsatisfactory |
| Developer (B/G) | OK |

As seen in Table 4, clean images are obtained having no fogging were obtained when the carriers A, C, E, G were used. However, foggy images were obtained when carriers B, D, and F were used.

When the carriers for electrophotography of the present invention are used as developers after mixing with toners, these carriers in the developers not only charge the toner very rapidly to a target charge amount, but also maintain the target amount of charge during printing, so that the chemical fogging and the image density, respectively related to the initial charging and the charge maintenance properties, can be eliminated.

What is claimed is:

1. An electrophotographic carrier obtained by coating magnetic particles with a resin, wherein the carrier satisfies the following equation $(B)>(-19.4)\times(A)+31$, wherein, (A) represents the carbon content of the carrier in weight percent, and (B) represents the slope of the plot of square root ($(CPS)^{1/2}$) of the number of emitted photoelectrons (CPS) versus excitation energy (eV) at excitation energies above the work function.

2. A carrier according to claim 1, wherein magnetic particles as the core material of the carrier is made of ferrite.

3. A carrier according to claim 1, wherein the resin which forms coating of the magnetic particles is a silicone resin.

4. An electrophotographic developer, which is provided with a toner comprising at least a colorant and a binder resin, and the carrier according to claim 1.

5. An electrophotographic developer according to claim 4, wherein said toner is made of polyester resin.

6. An electrophotographic developer according to claim 4, wherein said toner contains a charge control agent which has a positively charging capability.

7. A method for developing electrostatic images using the electrophotographic developer according to claims 4 to 6, comprising:

supplying said electrophotographic developer to a developing machine.

8. A method of developing electrostatic images using the electrophotographic developer according to claims 4 to 6, comprising:

supplying said electrophotographic developer to the developing belt of a developing machine at a developing belt speed of more than 20 m/minute.

* * * * *